United States Patent [19]

Ito et al.

[11] Patent Number: 4,569,306

[45] Date of Patent: Feb. 11, 1986

[54] VARNISH COATER FOR PRINTED PRODUCT

[75] Inventors: Kiyoshi Ito, Chiba; Tamotsu Omori, Ibaragi, both of Japan

[73] Assignee: Komori Printing Machinery Co., Ltd., Tokyo, Japan

[21] Appl. No.: 576,220

[22] Filed: Feb. 2, 1984

[30] Foreign Application Priority Data

Feb. 3, 1983 [JP] Japan ..... 58-16600

[51] Int. Cl.[4] ..... B05C 1/02

[52] U.S. Cl. ..... 118/249; 118/46; 118/236; 118/262

[58] Field of Search ..... 118/46, 249, 203, 262, 118/236; 101/350, 351, 352, 416 B

[56] References Cited

U.S. PATENT DOCUMENTS

| | | | |
|---|---|---|---|
| 2,788,742 | 4/1957 | French | 101/351 |
| 3,508,489 | 4/1970 | Norton | 118/262 X |
| 4,130,057 | 12/1978 | List et al. | 101/352 X |

*Primary Examiner*—John P. McIntosh

*Attorney, Agent, or Firm*—Blakely Sokoloff Taylor & Zafman

[57] ABSTRACT

In a varnish coater, a set of a blanket cylinder and a form roller and a set of a pan roller and a metering roller are driven by different drive sources. One-way clutches are arranged between the blanket cylinder and the form roller and between the form roller and a motor as one of the different drive sources, respectively. The form roller is selectively driven by one of the different drive sources through a corresponding one-way clutch. Alternatively, the form roller is driven by one of the drive sources which has a higher rotational speed.

5 Claims, 8 Drawing Figures

VARNISH COATER FOR PRINTED PRODUCT

BACKGROUND OF THE INVENTION

The present invention relates to a varnish coater disposed between a printing unit and a delivery apparatus of a rotary press or in an independent coating unit to apply varnish on a printed surface.

The surface of paper printed by a rotary printing press is not quickly dried and can be contaminated in the subsequent processing. In a sheet-fed rotary printing press, offsetting tends to be caused when printed sheets are stacked. In order to solve these problems, conventionally, a dryer is arranged in a delivery path of the printed products, or a powder is sprayed on the printed paper surfaces. However, in this case, the dryer becomes 1arge, and powder spraying results in surface roughening of the printed surface. Surface roughening tends to entail a loss of gloss and subsequent poor printing. Instead of these techniques, varnish is applied to the printed surface to prevent the surface from being contaminated and to give it gloss. Varnishing is performed in printed products such as covers of books, catalogs and pamphlets which require an aesthetic effect.

The varnish coater is used as an independent apparatus. However, recently, the varnish coater is generally disposed in a delivery path of a printing press to shorten a coating time and an associated operation time for restacking the printed sheets and hence to improve the coating efficiency. The varnish coater generally has rollers in the same manner as that of a dampening apparatus for dampening a surface of a plate mounted on a plate cylinder of the printing unit. Varnish stored in a varnish pan is supplied to a surface of a blanket cylinder through the rollers. The varnish is transferred to a sheet passing between the blanket cylinder and an impression cylinder.

However, in the conventional varnish coater of this type, there arise problems in respect to a rotation transmission mechanism of each roller and a nonuniform thickness of a varnish film caused thereby. The printing press is stopped when the sheets are restacked, or a stack board is replaced, or an underlay for a blanket of the blanket cylinder is adjusted due to a change in paper size. In such a case, the blanket cylinder is separated from the impression cylinder, while the rollers used for applying varnish continue to rotate to prevent varnish from hardening before the restart time.

It is occasionally required that the blanket cylinder be driven from the drive line side of the press, and that the rollers consisting of a pan roller (upsteam roller), a metering roller and a form roller be driven by another variable motor so as to adjust the thickness of a varnish film. When the above operation is performed, however irregular rotation occurs between the blanket cylinder and the form roller which are driven by the different drive sources, thus resulting in an irregular thickness of the varnish film. However, when the form roller is coupled to the blanket cylinder through a gear, the form roller must be stopped when the blanket cylinder is stopped for cleaning and adjustment of the underlay of the blanket. As a result, the varnish on the outer surface of the form roller is hardened, and the form roller must also be cleaned, resulting in inconvenience.

SUMMARY OF THE INVENTION

It is an object of the present invention to provide a varnish coater capable of preventing irregular rotation between a blanket cylinder and a form roller to obtain a uniform thickness of a varnish film and hence to improve quality of printed products.

It is another object of the present invention to provide a varnish coater capable of preventing varnish on the form roller from being hardened while the blanket cylinder is stopped.

It is still another object of the present invention to provide a varnish coater capable of simultaneously cleaning the blanket cylinder and the form roller.

It is still another object of the present invention to provide a varnish coater capable of minimizing wasted paper by separating the blanket cylinder from the form roller to check varnishing, thereby improving the coating efficiency.

It is still another object of the present invention to provide a low-cost varnish coater which eliminates a need for electrical control, thereby simplifying maintenance procedures and preventing erroneous operation.

In order to achieve the above and other objects of the present invention, there is provided a varnish coater for a printed product, comprising:

upstream rollers for picking up and metering varnish;

a form roller which is brought into contact with one of the upstream rollers to receive the varnish therefrom;

a blanket cylinder which is selectively brought into contact with the form roller and an impression cylinder;

a main drive source for driving the impression cylinder and selectively driving the form roller;

a subdrive source for driving the upstream rollers and selectively driving the form roller;

first and second one-way clutches arranged between the blanket cylinder and the form roller and between the form roller and the subdrive source, respectively; and a gear mechanism for selectively transmitting a rotational force to the form roller.

FIGS. *7a–7c* are a representation for explaining roller driving; and

Figure 8:
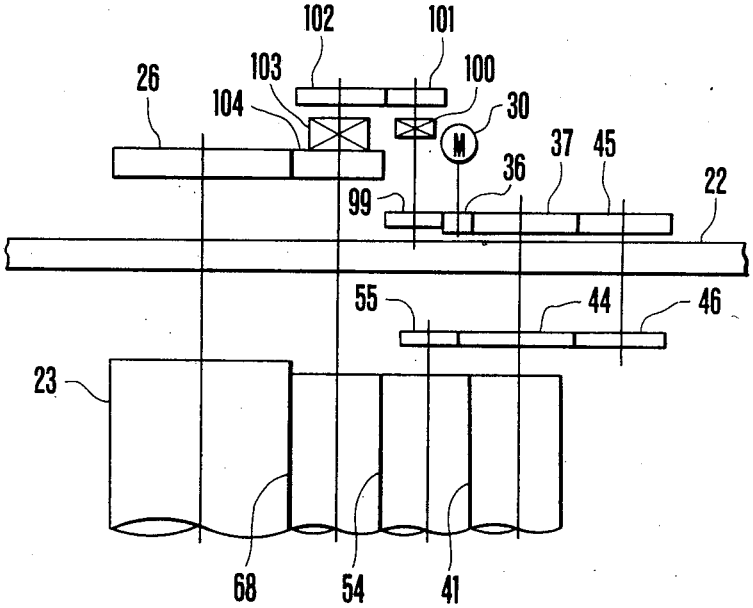

FIG. 8 is a schematic representation of a roller drive unit.

DESCRIPTION OF THE PREFERRED EMBODIMENT

Figure 1:
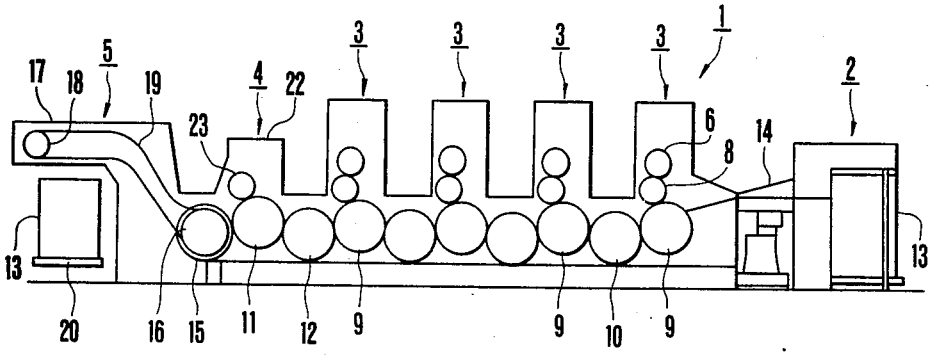
FIG. 1 is a schematic side view of a four-color sheet-fed offset rotary printing press.
Figure 2:
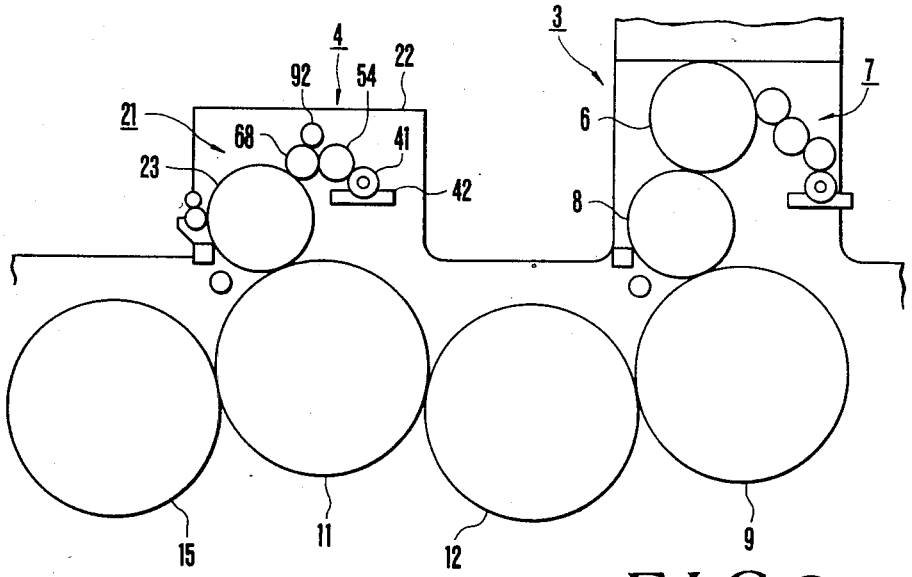
FIG. 2 is a schematic side view of a fourth color printing unit and a coating unit of the rotary printing press shown in FIG. 1.

Referring to FIGS. 1 and 2, a four-color sheet-fed offset rotary printing press 1 comprises a sheet feeder 2, four color printing units 3, a coating unit 4 and a delivery apparatus 5. These components are separately assembled and constitute the rotary printing press 1. Each printing unit 3 has a plate cylinder 6 having a printing plate thereon, an inking apparatus (not shown) for supplying a corresponding ink to the cylinder surface, and a dampening apparatus 7 for supplying dampening water to dampen the cylinder surface. A blanket cylinder 8 is brought into contact with each plate cylinder 6 on which an image is formed by utilizing the corresponding color ink and water. The image on the plate cylinder 6 is transferred to the blanket cylinder 8 upon relative rotation therebetween. In each printing unit 3, an impression cylinder 9 having a diameter twice that of the blanket cylinder 8 is brought into contact therewith. A transfer cylinder 10 having the same diameter as the impression cylinder 9 is sandwiched between adjacent impression cylinders 9 of the corresponding printing units 3. An impression cylinder 11 having a diameter twice that of a blanket cylinder 23 (having the same construction as the blanket cylinder 8) of the coating unit 4 is disposed to be in contact with the blanket cylinder 23 and at the same level as the other impression cylinders 9 of the printing units 3. A transfer cylinder 12 is sandwiched between the impression cylinder 9 of the fourth color printing unit 3 and the impression cylinder 11 of the coating unit 4. Paper sheets 13 stacked on the feed table of the sheet feeder 2 are taken up by a sheet pick-up device (not shown) and are fed one by one onto a feedboard 14. Each sheet 13 is gripped with grippers of the first color impression cylinder 9 by means of a swing gripper. The sheet 13 is printed by the blanket cylinders 8 with four colors while the sheet 13 is sequentially fed by the transfer cylinders 10 and the corresponding impression cylinders 9. The printed sheet is then gripped by grippers of the impression cylinder 11 and is wound therearound.

The delivery apparatus 5 comprises a delivery cylinder 15 which is brought into contact with the impression cylinder 11, and a pair of right and left sprockets 16 which are coaxially mounted on the delivery cylinder 15. Delivery chains 19 each having grippers at equal intervals are respectively looped between the right and left sprockets 16 and front end sprockets 18 of a delivery frame 17. The sheet 13 gripped by the grippers of the impression cylinder 11 is gripped by the grippers of the chains 19 and transferred thereby. The sheet 13 is released from the grippers of the chains onto a stack board 20.

The coating unit 4 having the construction described above has a varnish coater 21 to be described below.

Figure 3:
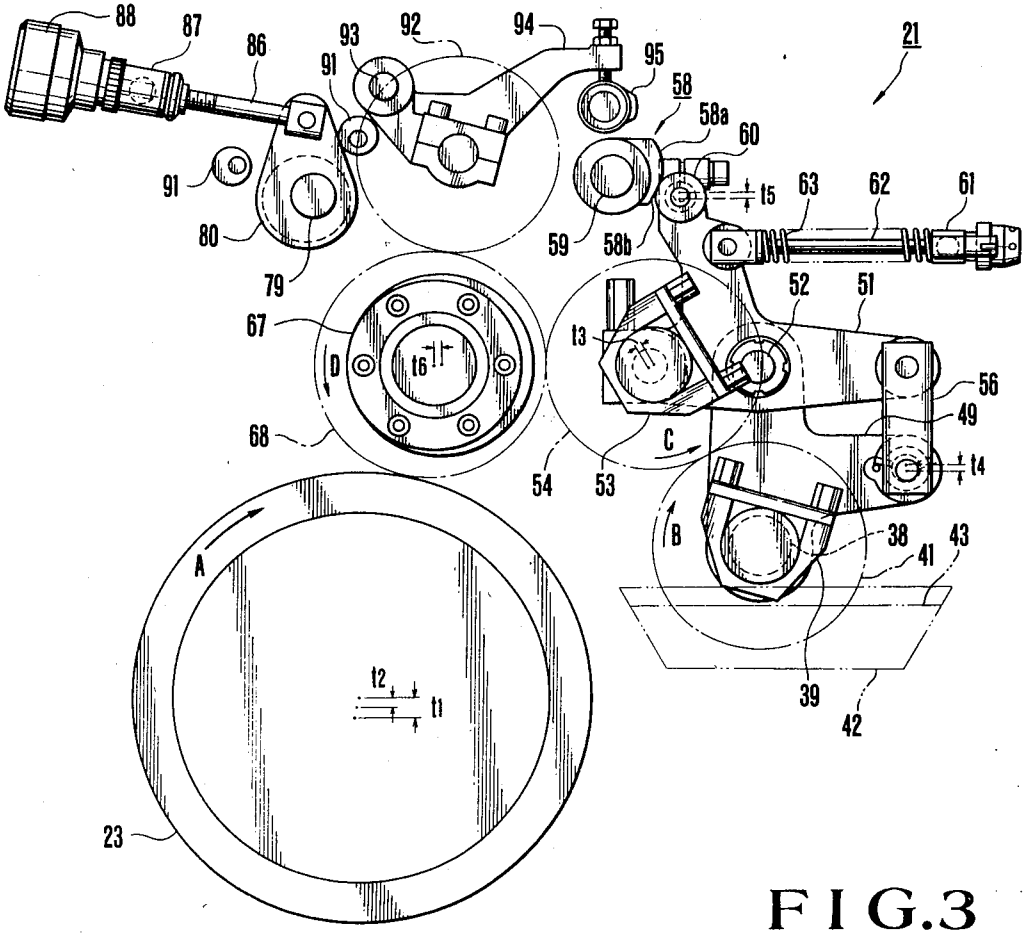
FIG. 3 is a side view of a varnish coater of the coating unit shown in FIG. 2 according to an embodiment of the present invention.
Figure 4:
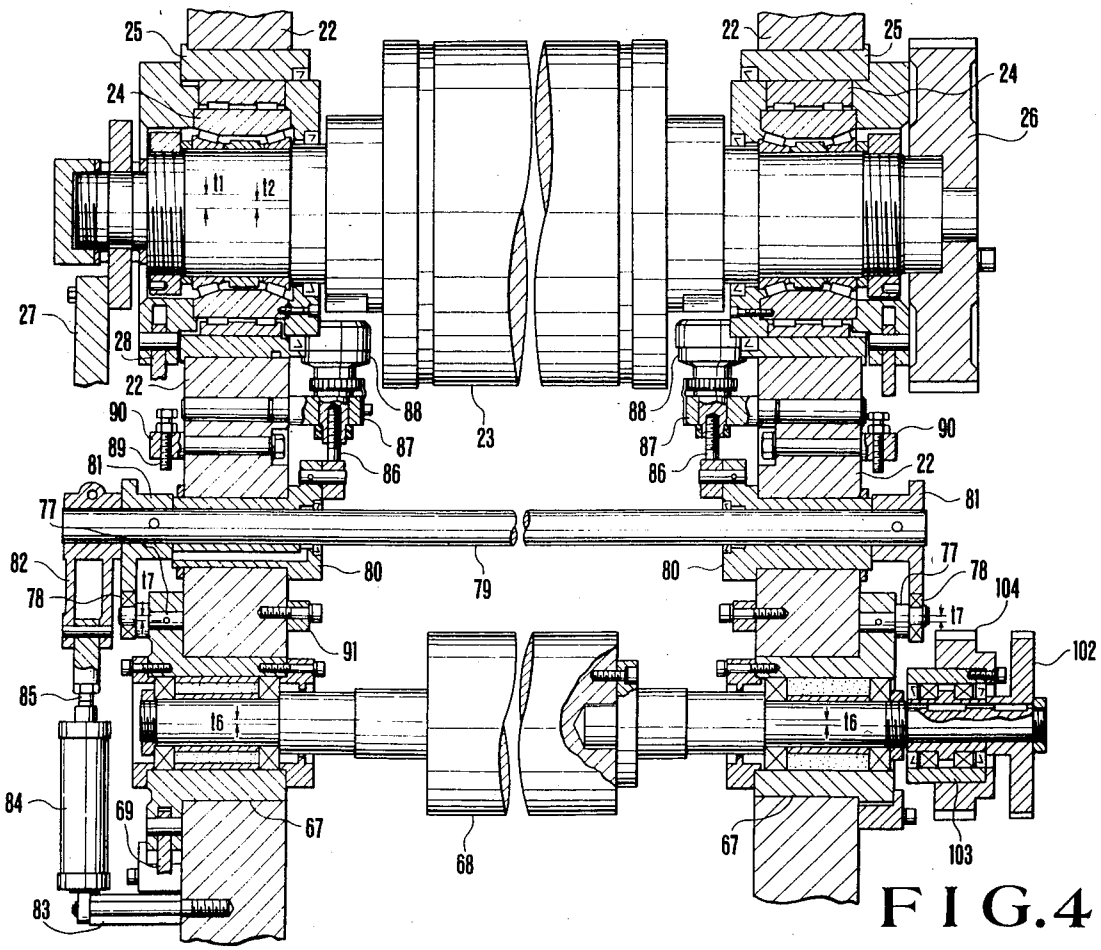
FIG. 4 is a developed sectional view of a portion including a blanket cylinder and a form roller of the varnish coater shown in FIG. 3.

Referring mainly to FIG. 4, the blanket cylinder 23 having the same diameter as that of the blanket cylinder 8 is rotatably supported by right and left frames 22, respectively, through pairs of antifriction bearings 24 and plain bearings 25. The blanket cylinder 23 is rotated in the direction indicated by arrow A (FIG. 3) upon rotation of a cylinder gear 26 coupled to a driving source. The axes of the bearings 24 and 25 are respectively deviated by distances t1 and t2 with respect to the axis of the blanket cylinder 23. A lever 27 pivotally mounted on the corresponding rolling bearing 24 of the frame 22 is reciprocated by means of an air cylinder to bring the blanket cylinder 23 into contact with or separate it from the impression cylinder 11. A lever 28 pivotally mounted on the plain bearing 25 is reciprocated by a handle to adjust the contact pressure between the blanket cylinder 23 and the impression cylinder 11.

Figure 5:
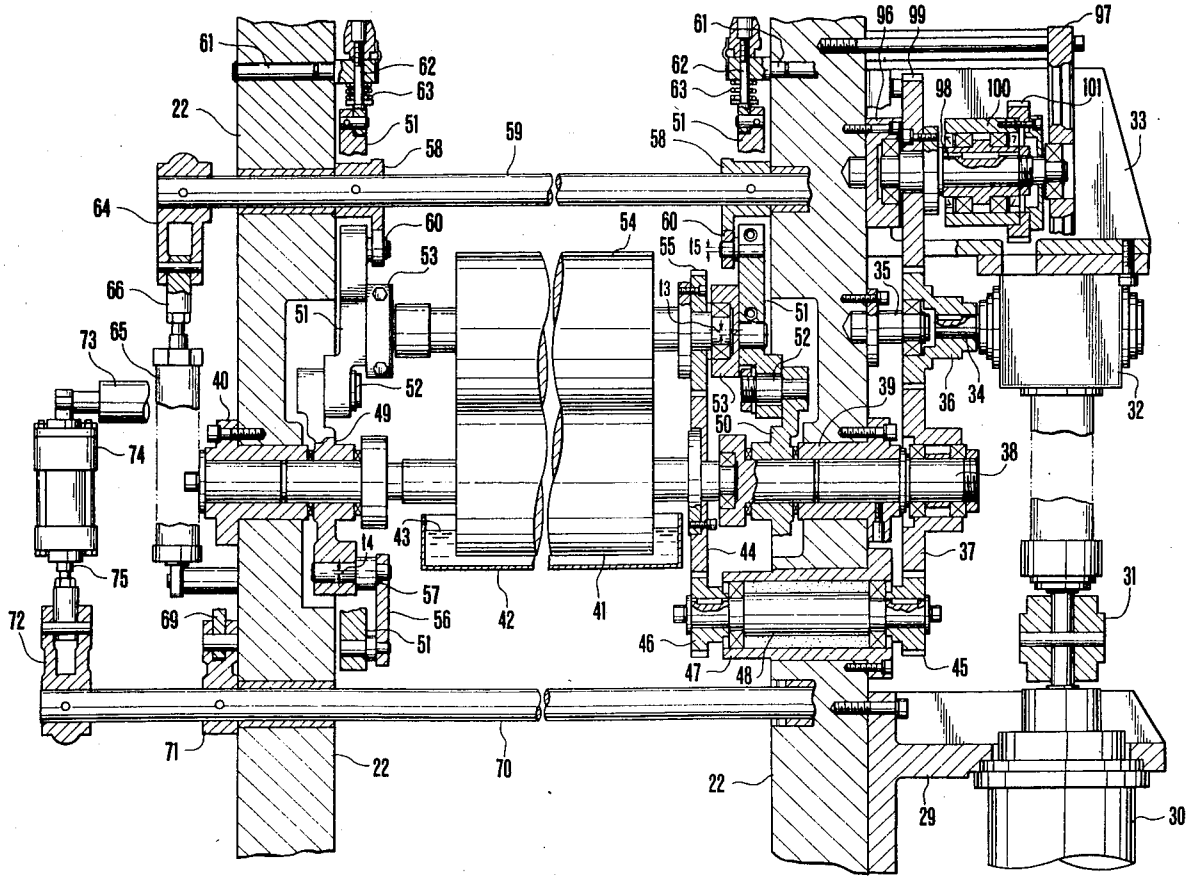
FIG. 5 is a developed sectional view of a portion including a pan roller and a metering roller of the varnish coater shown in FIG. 3.

Referring mainly to FIG. 5, a DC variable motor 30 is supported and mounted on a bracket 29 fixed on the outer surface of one of the frames 22. A gear box 32 coupled to the shaft of the motor 30 through a coupling 31 is supported and mounted on a bracket 33 fixed on the outer surface of this frame 22. A driving gear shaft 34 is coupled to the motor shaft through a bevel gear which is disposed in the gear box 32 to be perpendicular to the motor shaft. A driving gear 36 supported by a stud 35 which extends outward from the frame 22 is fixed on the driving gear shaft 34. A gear shaft 38 is supported on the frame 22 through a bearing 39 to rotatably support an intermediate gear 37 meshing with the driving gear 36. One end of a pan roller 41 is rotatably supported by the bearing portion of the gear shaft 38 extending inwardly of the frame 22. The other end of the pan roller 41 is supported by a bearing 40 of the opposing frame 22. The pan roller 41 is dipped in varnish 43 stored in a varnish pan 42. A pan roller gear 44 is fixed on a collar in the vicinity of the gear shaft 38. Reference numerals 45 and 46 denote gears which respectively mesh with the intermediate gear 37 and the pan roller gear 44 to transmit a rotational force of the intermediate gear 37 to the pan roller 41. The gears 45 and 46 are mounted on a gear shaft 48 supported by a bearing 47 which is mounted on the frame 22. The pan roller 41 rotates in a direction indicated by arrow B (FIG. 3). L-shaped roller arms 49 and 50 (the shape of the roller arm 49 is illustrated in FIG. 3 in detail) are movably mounted between the collar of the pan roller 41 and the bearing 40 and between the collar of the gear shaft 38 and the bearing 39 through thrust bearings, respectively. Inverted T-shaped arms 51 (the shape thereof is illustrated in FIG. 3 in detail) are pivotally mounted through pins 52 on corresponding free ends of the L-shaped roller arms 49 and 50, respectively. A bearing 53 is pivotally mounted on the free end of each of the T-shaped arms 51 such that the axis of the bearing 53 is deviated by a distance t3 (FIGS. 3 and 5) with respect to the shaft of a metering roller 54 having an elastic surface. Therefore, the roller 54 is supported by the bearings 53 and is brought in contact with the pan roller 41. A gear 55 mounted on the end portion of the shaft of the roller 54 is meshed with the pan roller gear 44, so that the roller 54 is rotated in the direction indicated by arrow C (FIG. 3). Bolts are loosened to pivot the bearings 53 so as to adjust a nip pressure acting on the pan roller 41.

One of the roller arms 49 is coupled to the corresponding T-shaped arm 51 through a lever 56 having an eccentric portion indicated by a distance t4 (FIGS. 3 and 5). A pin 57 of the eccentric portion is manually pivoted to throw on/off the metering roller 54 with respect to the pan roller 41. Reference numeral 58 denotes cams each having a large diameter portion 58*a* (FIG. 3) and a small diameter portion 58*b* (FIG. 3). The cams 58 are mounted on end portions of a cam shaft 59 mounted across the right and left frames 22. These end portions are adjacent to the inner surface portions of the right and left frames 22, respectively. Rollers 60 eccentrically (indicated by a distance t5) mounted on the free ends of the T-shaped arms 51 are in contact with the cam surfaces of the cams 58, respectively. Pivotal spring shafts 62 are mounted on studs 61 extending inward from the frames 22. One end of each of pivotal spring shafts 62 is pivotally mounted on the corresponding T-shaped arm 51. The T-shaped arms 51 urge the rollers 60 which tend to abut against the cams 58 by means of compression coil springs 63 mounted on the spring shafts 62, respectively. A piston rod 66 of an air cylinder 65 having an end mounted on the corresponding frame is pivotally coupled to the free end portion of a lever 64 fixed on the end of the cam shaft 59. When the piston rod 66 is moved to pivot the cams 58, the metering roller 54 can be brought into contact with or separated from the pan roller 41 through the rollers 60 and the T-shaped arms 51.

Figure 6:
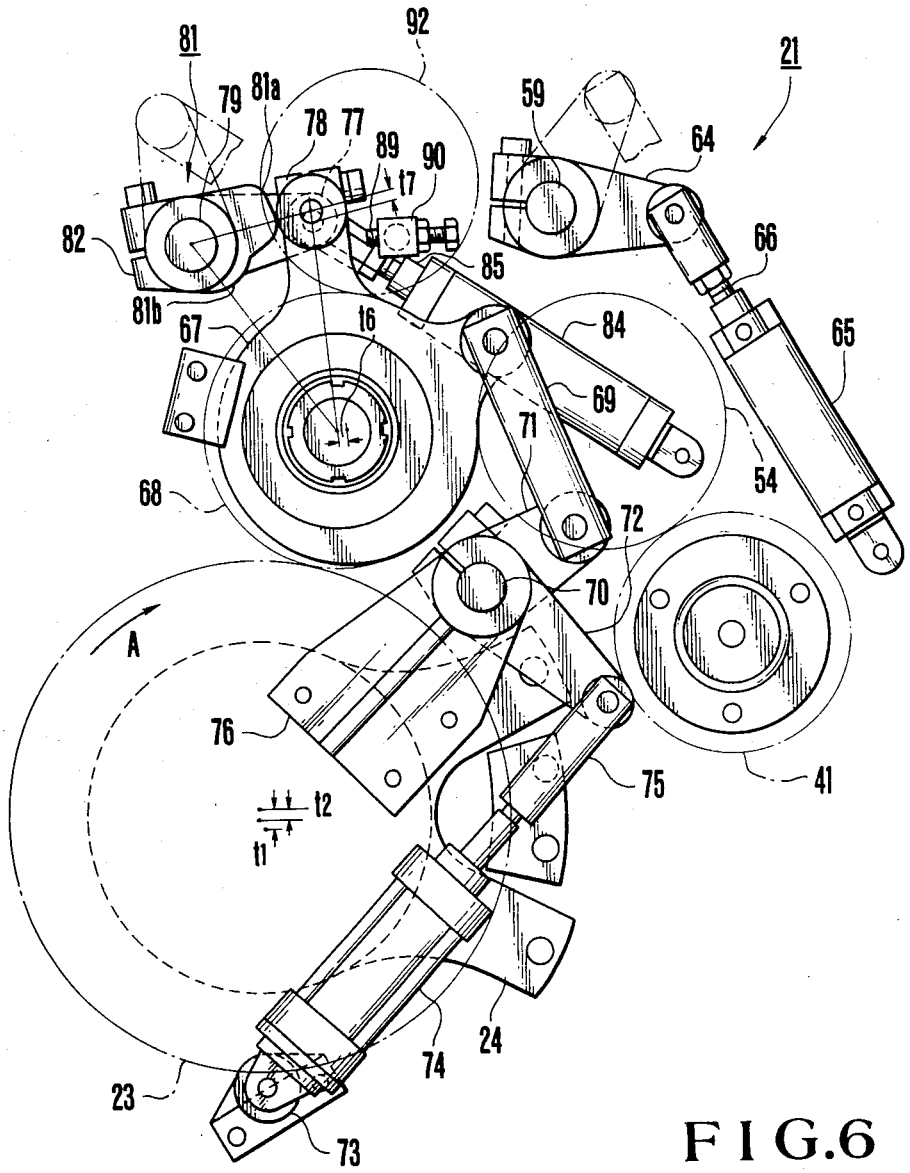
FIG. 6 is a side view of a throw-on and -off mechanism for rollers in correspondence with the portion shown in FIG. 3 when viewed from the outside of the frame.

Referring again to FIGS. 3 and 4, eccentric bearings 67 (indicated by a distance t6 in FIG. 3) are respectively mounted on the frames 22 above the blanket cylinder 23. A form roller 68 is supported by the eccentric bearings 67 and is brought into contact with the blanket cylinder 23. As shown in FIG. 4, one end of a connecting lever 69 is coupled to an outwardly extended portion of one of the eccentric bearings 67, and the other end thereof is coupled to a lever 71 which is mounted on a lever shaft 70 mounted on the frame 22. An actuator end of a piston rod 75 of an air cylinder 74 pivotally coupled to the stud 73 extending outwardly from the frame 22 is coupled to a lever 72 fixed on one end of the lever shaft 70. When the piston rod 75 of the air cylinder 74 is moved to pivot the eccentric bearings 67 through the coupling lever 69 and the like, the form roller 68 can be thrown on/off with respect to the blanket cylinder 23. Referring to FIG. 6, reference numeral 76 denotes a bearing fixed on the bracket at the side of the frame 22 to support the lever shaft 70 outside the frame 22. As shown in FIG. 4, the roller shafts 77 are split-clamped to be pivoted. Inner rings of rollers 78 each comprising a ball bearing are respectively fixed at the eccentric portions deviated by distances t7 with respect to the axis of the roller shaft 77. Reference numeral 79 denotes a cam shaft supported by the right and left frames 22 respectively through eccentric bearings 80. As shown in FIG. 6, the position of the cam shaft 79 is preset such that the axes of the cam shaft 79, the roller 78 and the form roller 68 correspond to apexes of a right angled triangle. Cams 81 each having a large diameter portion 81*a* and a small diameter portion 81*b* are split-clamped on the cam shaft 79. In other words, the cams 81 are respectively pivotal about the eccentric bearings 80 through the cam shaft 79. A lever 82 is split-clamped on the projecting end of the cam shaft 79, and the actuator end of a piston rod 85 of an air cylinder 84 pivotally supported by the frame 22 through a stud 83 is pivotally coupled to the free end portion of the lever 82. Bolts 86 respectively extend from the extended portions of the eccentric bearings 80 which extend inside the frames 22. The bolts 86 respectively engage with nuts such that these bolts 86 are inserted in handles 88 supported by studs 87 so as not to move axially. When the handles 88 are turned to move the bolts 86 so as to turn the eccentric bearings 80, respectively, the cams 81 are eccentrically moved together with the cam shaft 79 to shift its axis. In this throw-on and -off mechanism of the form roller 68, when the piston rod 75 (FIG. 5) of the air cylinder 74 is shortened (i.e., when the eccentric bearings 67 are pivoted clockwise in FIG. 6), the form roller 68 is separated from the blanket cylinder 23. In this case, the eccentric direction of the bearings 67 is preset such that the form roller 68 is separated from the blanket cylinder 23 while the distance between the form roller 68 and the metering roller 54 is kept to be substantially constant. In the state shown in FIG. 6, the blanket cylinder 23 is in contact with the form roller 68. In this case, the piston rod of the air cylinder 84 is shortened, and the large diameter portion 81*a* of each cam 81 is in contact with the corresponding roller 78. The roller 78 is biased by an air pressure of the air cylinder 74 to abut against the corresponding cam 81. Furthermore, when the blanket cylinder 23 is removed and the form roller 68 is thrown on the blanket cylinder 23, the piston rod 85 of the air cylinder 84 is elongated to pivot the cams 81 counterclockwise. As a result, the rollers 78 are respectively brought into contact with the small diameter portions 81*b* of the cams 81 by means of the biasing force of the air cylinder 74. Therefore, the form roller 68 is held in a state wherein it contacts the blanket cylinder 23. In other words, in the throw-on and -off positions of the blanket cylinder 23, the contact forces of the form roller 68 with respect to the blanket cylinder 23 are limited by the large diameter portions 81*a* and the small diameter portions 81*b* of the cams 81. Adjustment of these contact forces is effected by the movement of the cam 81 caused by the turning of the handle 88. Referring to FIG. 4, reference numeral 89 denote off-position stoppers which are screwed in studs 90 on the frames 22, respectively. When the blanket cylinder 23 is located in the throw-on position, the piston rod 75 of the air cylinder 74 is shortened, and the eccentric bearings 67 are respectively pivoted until they abut against the stoppers 89. Therefore, the throw-off position of the form roller 68 can be defined with respect to the throw-on position of the blanket cylinder 23. Referring to FIG. 4, reference numeral 91 denotes stoppers for defining the eccentric pivotal movement of the cams 81 when the lever 82 respectively abuts against the stoppers 91. As shown in FIG. 3, a rider roller 92 is supported at each end thereof by an arm 94 pivotal about a pin 93 on the side of the frame 22 and is brought in tight contact with the form roller 68. The arm 94 swings upon pivotal movement of a cam 95 by means of a handle (not shown), so that the rider roller 92 can be thrown on/off with respect to the form roller 68.

The drive mechanism of the motor 30, the cylinder gear 26 and the form roller 68 will be described with reference to mainly FIGS. 7 and 8.

One end of a clutch shaft 98 is supported by a bearing 96 fixed on the frame 22 in the vicinity of the motor 30, and the other end thereof is supported by a bracket 97 extending from the frame 22. A gear 99 is fixed on the clutch shaft 98 and is meshed with the driving gear 36 to transmit rotation of the motor 30 to the clutch shaft 98. A clutch gear 101 fixed on a one-way clutch 100 (to be described in detail later) on the clutch shaft 98 is meshed with a form roller gear 102 fixed in the end portion of the roller shaft of the form roller 68. The one-way clutch 100 has a known structure capable of transmitting a rotational force in only one direction. In this embodiment, the form roller 68 is a driven member, so that the rotational force of the motor 30 is transmitted only to the form roller 68. A one-way clutch 103 having the same construction as the one-way clutch 100 is arranged in an end portion of a roller shaft of the form roller 68. A clutch gear 104 coupled to the one-way clutch 103 is meshed with the cylinder gear 26 of the blanket cylinder 23. In this case, the form roller 68 is the driven member for the one-way clutch 103, so that the rotational force of the blanket cylinder 23 is transmitted only to the form roller 68. In this manner, the form roller 68 is selectively driven by the motor 30 and the blanket cylinder 23 through the one-way clutches 100 and 103; the form roller 68 does not simultaneously receive the rotational forces through the one-way clutches 100 and 103. Either of the one-way clutches 100 and 103 which transmits a higher rotational speed is coupled to the form roller 68, and the other one of the one-way clutches 100 and 103 which transmits a lower rotational speed is decoupled from the form roller 68.

Figure 7A:
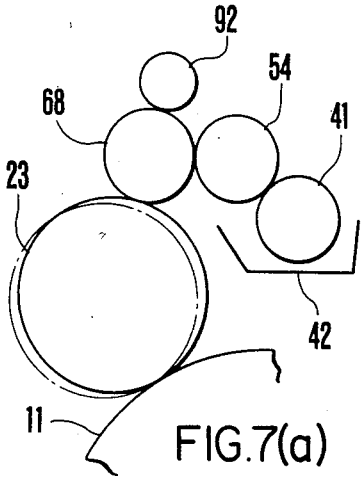
Figure 7B:
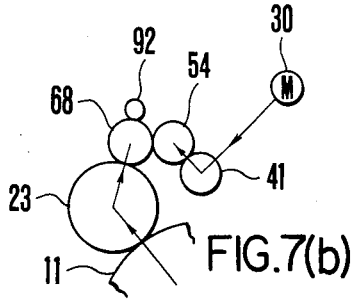
Figure 7C:
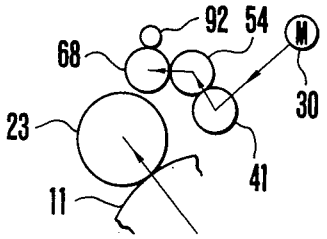

Referring to FIG. 7(*a*), the solid line position of the blanket cylinder 23 is defined as a throw-on position with respect to the form roller 68 and the impression cylinder 11. FIG. 7(*b*) shows a rotation transmission path when the blanket cylinder 23 is located in the throw-on position. In this case, the pan roller 41 and the metering roller 54 are driven by the motor 30, and the form roller 68 is driven by the impression cylinder 11 and the blanket cylinder 23 through the one-way clutch 103. Therefore, the one-way clutch 100 is decoupled from the form roller 68. Referring again to FIG. 7(*a*), the dotted line position of the blanket cylinder 23 is defined as a throw-off position with respect to the form roller 68. FIG. 7(*c*) shows a rotation transmission path when the blanket cylinder 23 is located in the throw-off position. In this case, the form roller 68 is driven by the motor 30 through the pan roller 41 and the metering roller 54 via the one-way clutch 100. Only the blanket cylinder 23 is driven by the impression cylinder 11. Therefore, the one-way clutch 103 is decoupled from the form roller 68.

The operation of the varnish coater 21 having the arrangement described above will now be described. The motor 30 of the varnish coater 21 is started to perform the coating operation while the blanket cylinder is located at the throw-off position. The cams 58 are pivoted by the air cylinder 65 to abut the rollers 60 against the small diameter portions 58*b* of the cams 58, respectively, so that the metering roller 54 is brought into tight contact with the pan roller 41 and the form roller 68 by means of the biasing forces of the compression coil springs 63. In this case, the piston rod 75 of the air cylinder 74 is elongated so that the rollers 78 of the eccentric bearings 67 are respectively brought into tight contact with the large diameter portions 81*a* of the cams 81. The form roller 68 is located in the throw-on position. However, since the blanket cylinder 23 is located in the throw-off position, the form roller 68 is separated from the blanket cylinder 23. In this case, the rotation of the motor 30 is transmitted to the pan roller 41 and the metering roller 54 through the bevel gears in the gear box 32, and the gears 36, 37, 45, 46, 44 and 55. The rotation of the motor 30 is also transmitted to the form roller 68 through the gears 36 and 99, the one-way clutch 100 and the gears 101 and 102. The blanket cylinder 23 is separated from the impression cylinder 11, and these cylinders are stopped. Upon rotation of the above-mentioned rollers, the varnish 43 is drawn by the pan roller 41 from the varnish pan 42. A thickness of the varnish film is adjusted upon contact between the pan roller 41 and the metering roller 54. The varnish film having a predetermined thickness is transferred to the form roller 68. Varnish circulates through the pan roller 41, the metering roller 54 and the form roller 68. When the rotary printing press is started to feed a sheet 13 onto the feedboard 14 by means of the automatic feeder 2, the blanket cylinders 8 of the printing units 3 are located in the throw-on positions, so that the sheet 13 is subjected to four-color process printing through the blanket cylinders and the corresponding impression cylinders 9. The printed sheet is fed toward the coating unit 4. When the printed sheet reaches the coating unit 4, the plain bearings 25 are pivoted in response to the command from a timing controller, so that the blanket cylinder 23 is located in the throw-on position, and that the blanket cylinder 23 is brought into tight contact with the impression cylinder 11 and the form roller 68. Varnish circulating between the form roller 68 and the pan roller 41 is transferred to the blanket cylinder 23 and is applied to the printed sheet passing between the blanket cylinder 23 and the impression cylinder 11. The coated sheet 13 is fed by the delivery chains 19 and is stacked on the stack board 20. In the throw-on position of the blanket cylinder 23, the rotational force is transmitted from the motor 30 to the form roller 68 through the one-way clutch 100. At the same time, since the blanket cylinder 23 is located in the throw-on position, the rotational force of the blanket cylinder 23 is transmitted to the form roller 68 through the gears 26 and 104 and the one-way clutch 103. The rotational speed of the blanket cylinder 23 is higher than that of the motor 30, so that only the rotational force of the blanket cylinder 23 is transmitted to the form roller 68. The one-way clutch 100 is decoupled from the form roller 68.

When the coating operation is completed and the stack board 20 of the delivery apparatus 5 is replaced with an empty stack board, or the underlay of the blanket is adjusted if the blanket becomes thin, sheet feeding is stopped. In this condition, the blanket cylinders 8 of the printing units are moved in the throw-off positions, and the blanket cylinder 23 is simultaneously thrown off with respect to the impression cylinder 11 and the form roller 68. In this case, the cylinder gear 26 is slightly meshed with the gear 104, and the motor 30 continues to rotate. Therefore, the form roller 68 continues to be driven by the blanket cylinder 23 through the one-way clutch 103. At the same time, the pan roller 41 and the metering roller 54 continues to be driven by the motor 30, so that the varnish 43 circulates in a path between the varnish pan 42 and the form roller 68 and will not be hardened. In the case of adjusting the underlay of the blanket of the blanket cylinder 23, the rotary printing press is stopped, and the blanket cylinder 23 is cleaned and the underlay is adjusted. In this case, the form roller 68 is driven by the motor 30 through the one-way clutch 100. After the underlay is adjusted, the rotary printing press is started. When the air cylinder 84 is actuated to elongate the piston rod 85, the cams 81 are rotated counterclockwise (FIG. 6) through about 90°. In this case, the eccentric bearings 67 are biased by the air cylinder 74 and are rotated until the rollers 78 respectively abut against the small diameter portions 81*b* of the cams 81. Therefore, the form roller 68 is brought into contact with the blanket cylinder 23 which is located in the off position, and the varnish under circulation is transferred to the blanket cylinder 23. The cylinder gear 26 is meshed with the gear 104, so that the form roller 68 is driven by the blanket cylinder 23 through the one-way clutch 103 at a speed higher than the rotational speed of the motor 30 since the rotation of the impression cylinder is transmitted through meshing between the gears 26 and 104 even if the blanket cylinder 23 is located in the throw-off position. Thereafter, when the sheet 13 is fed and reaches the blanket cylinder 23, the air cylinders 74 and 84 are actuated in response to predetermined timing signals from the timing controller. As a result, the rollers 78 are respectively brought into tight contacts with the large diameter portions 81*a* of the cams 81, and the blanket cylinder 23 is located in the throw-on position. Therefore, the form roller 68 is brought into tight contact with the blanket cylinder 23 by a contact pressure preset by the cams 81 and the rollers 78, thereby to restore the coating condition which existed before sheet feeding was stopped. In order to simultaneously clean the form roller 68 and the blanket cylinder 23, the form roller 68 is brought into contact with the blanket cylinder 23 which is located in the throw-off position. The form roller 68 is driven through the blanket cylinder 23. In addition, in order to manually clean the blanket cylinder 23, the blanket cylinder 23 is located in the throw-off position, and the impression cylinder 11 is stopped. The blanket cylinder 23 can be washed while the form roller 68 is located in the off state with respect to the blanket cylinder 23. Therefore, the form roller 68 is driven by the motor 30.

The present invention is not limited to the particular embodiment described above. It is essential to rotate the blanket cylinder in synchronism with the form roller. For example, the form roller 68 can be brought into tight contact with only the pan roller 41, and the metering roller 54 can be brought into tight contact with only the pan roller 41. The same effect as in the above embodiment can be obtained even in this modification. The rotational direction of the rollers is not limited to the way as described above.

As is apparent from the above embodiment, in the varnish coater for the printed product, the blanket cylinder and the form roller, and the rollers located in the upstream of the form rollers are driven by the separate drive sources. The one-way clutches are arranged between the blanket cylinder and the form roller and between the form roller and the upsteam drive source, respectively. The form roller is selectively driven by one of the blanket cylinder drive source and the upstream drive source. In addition, the form roller is driven by one of the drive sources which has a higher rotational speed. The form roller can be driven without damage irrespective of the throw-on and -off operation between blanket cylinder and the form roller. Therefore, the coating operation can be properly performed, varnish can be applied to the rollers while the blanket cylinder and the form roller are respectively located in the throw-off positions, and the varnishing operation can be checked while the blanket cylinder and the form roller are respectively located in the throw-off and throw-on positions. These operations can be performed without irregular rotation between the blanket cylinder and the form roller, thereby eliminating the nonuniform thickness of the varnish film and hence improving the quality of the printed products. In addition, while the blanket cylinder is stopped, the form roller can be continuously rotated together with the metering roller and the pan roller, thereby preventing hardening of varnish. Furthermore, varnishing can be checked while the blanket cylinder is located in the throw-off position, thereby decreasing occurrence of wasted paper and improving the coating operation. In addition to these advantages, the electrical control system is not required, so that a low-cost varnish coater can be obtained, the maintenance procedures can be simplified, and the erroneous operation can be eliminated.

What is claimed is:

1. A varnish coater for a printed product, comprising:

upstream rollers for picking up and metering varnish;

a form roller which is brought into contact with one of said upstream rollers to receive the varnish therefrom;

a blanket cylinder which is selectively brought into contact with said form roller and an impression roller;

a main drive source for driving said impression roller and selectively driving said form roller;

a subdrive source for driving said upstream rollers and selectively driving said form roller;

first and second one-way clutches arranged between said blanket cylinder and said form roller and between said form roller and said subdrive source, respectively; and a gear mechanism for selectively transmitting a rotational force to said form roller;

wherein said subdrive source drives said form roller via a subdrive source gear, a first transfer gear meshed with the subdrive source gear, said second one-way clutch, a second transfer gear meshed with a form roller gear, and said form roller gear, when said blanket cylinder is separated from said form roller, said subdrive source gear, said first and second transfer gears and said form roller gear being included in said gear mechanism.

2. A varnish coater according to claim 1, wherein said main drive source drives said blanket cylinder through said impression cylinder, and said blanket cylinder drives said form roller through a blanket cylinder gear, a first one-way clutch gear meshed with said blanket cylinder gear and, said first one-way clutch when said blanket cylinder is held in a throw-on position, and said blanket cylinder gear, said first one-way clutch gear, being included in said gear mechanism.

3. A varnish coater according to claim 1, wherein said form roller is driven by one of said main drive source and said subdrive source which has a higher rotational speed.

4. A varnish coater according to claim 3, wherein said main drive source has a rotational speed higher than that of said subdrive source.

5. A varnish coater according to claim 1, wherein said upstream rollers comprise a metering roller and a pan roller, said pan roller being dipped in varnish.

* * * * *